United States Patent [19]

Pontius et al.

[11] 4,233,037

[45] Nov. 11, 1980

[54] METHOD OF AND APPARATUS FOR REDUCING BACK CORONA EFFECTS

[75] Inventors: Duane H. Pontius, Birmingham; Wallace B. Smith, Trussville, both of Ala.

[73] Assignee: The United States of America as represented by the Administrator U.S. Environmental Protection Agency, Washington, D.C.

[21] Appl. No.: 57,163

[22] Filed: Jul. 13, 1979

Related U.S. Application Data

[63] Continuation of Ser. No. 882,673, Mar. 2, 1978, abandoned.

[51] Int. Cl.[3] ..... B03C 3/08; B03C 3/40

[52] U.S. Cl. ..... 55/2; 55/137

[58] Field of Search ..... 55/2, 6, 129, 130, 136–138, 55/150, 151, 131; 361/230

[56] References Cited

U.S. PATENT DOCUMENTS

| | | | |
|---|---|---|---|
| 1,943,070 | 1/1934 | Grave | 55/130 |
| 2,142,129 | 1/1939 | Hoss et al. | 55/131 |
| 2,192,250 | 3/1940 | White | 55/137 |
| 2,377,391 | 6/1945 | White | 55/2 |
| 2,873,000 | 2/1959 | Elam | 55/138 |

FOREIGN PATENT DOCUMENTS

| | | | |
|---|---|---|---|
| 1493419 | 11/1977 | United Kingdom | 55/130 |

*Primary Examiner*—David L. Lacey

[57] ABSTRACT

An apparatus and method for reducing back corona effects while charging high resistivity dust or the like in a corona field, includes a corona discharge electrode, a passive electrode and a screen electrode, the screen electrode being positioned between the discharge electrode and the passive electrode. The screen electrode is positioned more closely to the passive electrode than the discharge electrode and is supplied with an electrical potential which is of the same polarity as and a fraction of the magnitude of the discharge electrode relative to the passive electrode. Gas having entrained therein the particulate material, which is to be removed, flows between the screen and discharge electrode and thence to a particulate material collection stage. The space between the screen and corona discharge electrode remains essentially a unipolar ion field, while ions of the opposite polarity originating at passive electrode due to back corona are collected by the screen electrode.

8 Claims, 4 Drawing Figures

METHOD OF AND APPARATUS FOR REDUCING BACK CORONA EFFECTS

This is a continuation of application Ser. No. 882,673 filed Mar. 2, 1978 now abandoned.

BACKGROUND OF THE INVENTION

This invention relates to a method of and apparatus for reducing back corona effects in the process of charging particulate material in an electrostatic precipitator. More particularly, the present invention relates to a method of and apparatus for reducing the effects of back corona so that a substantially unipolar ion field is maintained for charging particulate material in a charging stage upstream from a particulate material collecting stage.

Many conventionally applied methods and apparatus for control of back corona are based principally upon reducing the resistivity of particulate matter collected by electrostatic precipitation. Conditioning reagents are sprayed into the gas stream or introduced into the boiler along with the coal. These methods require special systems for handling and dispensing chemical conditioning agents in large quantities.

The effectiveness of the invention does not depend upon the chemical nature of the particulate material to be precipitated. No chemical agents are required.

It is known from U.S. Pat. No. 2,142,129 entitled "Apparatus for Electrical Precipitation" to Hoss et al. to pass gas with entrained particulate material into an apparatus which includes an external housing, a centrally located corona discharge electrode and an apertured intermediate electrode, the intermediate electrode being held at a potential less than but of the same polarity as the discharge electrode. The gas in which is entrained the particulate material passes radially through the apertured electrode towards the internal surface of the housing. The housing acts as the dust collecting electrode and the gas is passed out of the apparatus via an opening between the housing and the apertured electrode. Apparatus of this general type have the disadvantage that dust which collects between the apertured electrode and housing tends to cause electrical discharges and the probability of back corona discharge is also considerable.

It is known from U.S. Pat. No. 1,605,648 entitled "Art of Separating Suspended Matter from Gases" to M. W. Cooke to pass gas with entrained particulate material into an apparatus which includes an external housing, a centrally located corona discharge electrode and an apertured intermediate electrode, the intermediate electrode being held at the same polarity and potential as the housing with respect to the discharge electrode. The gas with the entrained particulate material is passed into the apparatus, the particulate material collecting on the outside of the intermediate electrode in the neutral zone between this electrode and the housing with the gas passing outwardly via a circumferential opening between the discharge and apertured electrodes. Here again, the disadvantages of back corona and electrical discharges exist.

Electrostatic precipitators are known which include a charging section or stage having a passive electrode and a corona discharge electrode between which gas containing particulate material is passed, the passive electrode surrounding the discharge electrode. The particulate material becomes charged, as a result of the corona discharge, and with the gas is passed to a further stage provided with an electrical field which effects precipitation of the charged particulate material. An example of precipitators of this preconditioning type can be seen in U.S. Pat No. 3,747,299 entitled "Electrostatic Precipitator" to Ta-Kuan Chiang and the patent to Hoss et al, supra. It is believed that the possibility of sparking is reduced, as compared with the apparatus disclosed in the patent to Cooke, supra, because dust and other particulate material are not collected on the passive electrode. Nevertheless, the disadvantage of back corona discharge is present and, when taking place, can seriously reduce and even virtually completely counteract the desired charging of the entrained particulate material.

The techniques of charging particulate material in electrostatic precipitators as noted above depends upon the presence of ions, principally of a single polarity, in the charging region. If comparable quantities of both positive and negative ions are present, very poor particle charging results, because of the competing effects of the oppositely charged ions. In a conventional electrostatic precipitator a layer of high resistivity particulate material on the passive electrode may suffer electrical breakdown, resulting in a corona discharge from the surface of the passive electrode. This phenomenon, known as back corona, produces an undesirable bipolar ion field in most of the space between the electrodes of the corona system.

SUMMARY OF THE INVENTION

It is the principal object of the present invention to provide a method of and apparatus for reducing the undesirable bipolar ion field between electrodes in the charging section or stage of an electrostatic precipitation system.

It is another object of the present invention to provide a method of and apparatus for removing from an electrostatic precipitation system ions of incorrect polarity produced by back corona discharge.

It is a further object of the present invention to provide a method of and apparatus for allowing ions of one polarity to flow between a corona discharge electrode and a passive electrode, while capturing ions of opposite polarity which may be produced from the passive electrode in the particulate material charging section or stage of an electrostatic precipitation system.

The present invention, in its apparatus aspect, achieves the foregoing objects, as well as others, which are to become clear below, by providing in an electrostatic precipitator a charging stage with a three-electrode corona system designed to suppress the effects of the ions resulting from back corona discharge by removing them from the region near the passive electrode. This function is performed by a screen electrode placed near the passive electrode and conforming approximately to its shape. The screen electrode is insulated from the passive electrode and placed at an electrical potential with the same polarity, but a fraction of the magnitude of the voltage on the corona discharge electrode. With the screen voltage properly adjusted, ions originating at the discharge electrode will be deflected away from the metal in the screen, and will proceed through the open areas to the passive electrode. Ions originating at the passive electrode due to back corona, however, will be of the opposite polarity, and will be attracted to the metal in the screen, to be trapped and removed from the system. The space between the screen and the corona discharge electrode thus remains essentially a unipolar ion field.

The gas containing particulate material sought to be removed is passed axially through the charging stage between the corona discharge electrode and the screen electrode and thence on to the collecting stage where the charged particulate material is collected.

The present invention, in its method aspect, achieves the foregoing objects, as well as others, which are to become evident below, by passing gas containing particulate material to be removed through a charging stage between a corona discharge electrode and an intermediate electrode positioned between the discharge electrode and a passive electrode so as to charge the particulate material by corona discharge of one polarity, while removing ions of opposite polarity, which may be produced from the passive electrode, by capturing such ions by the intermediate electrode. The intermediate electrode is maintained at the same polarity as the corona discharge electrode, but at a fraction of its magnitude.

DETAILED DESCRIPTION OF THE PREFERRED EMBODIMENTS

Figure 1:
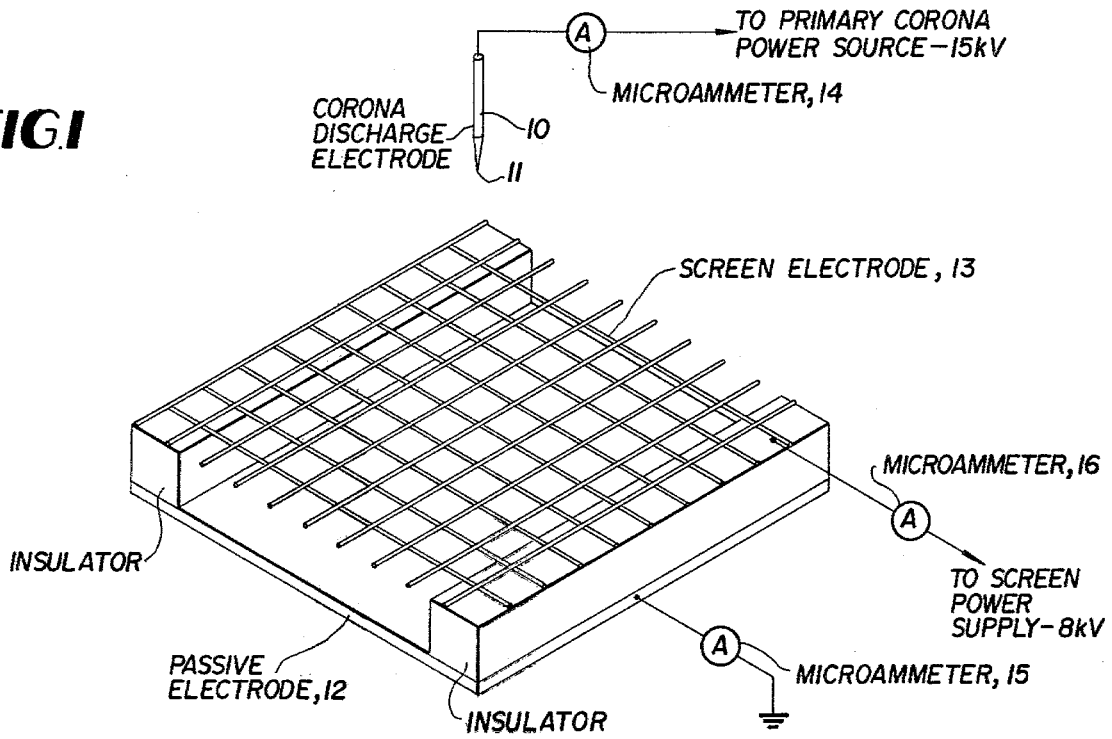
FIG. 1 is a simplified, partially schematic, pictorial view of an apparatus used to verify the three-electrode corona concept utilized in the present invention.
Figure 2:
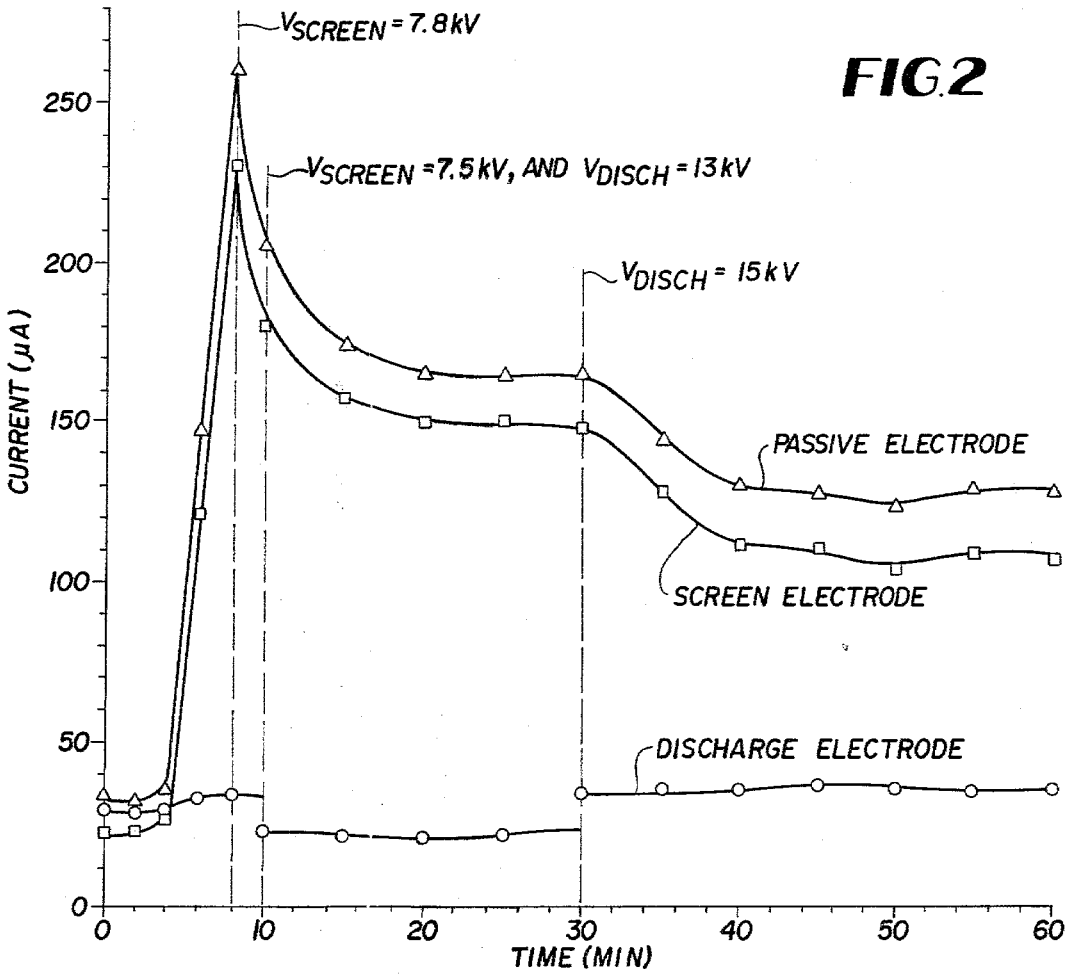
FIG. 2 is a graphic representation of electrode currents in the apparatus shown in FIG. 1.
Figures 3, 4:
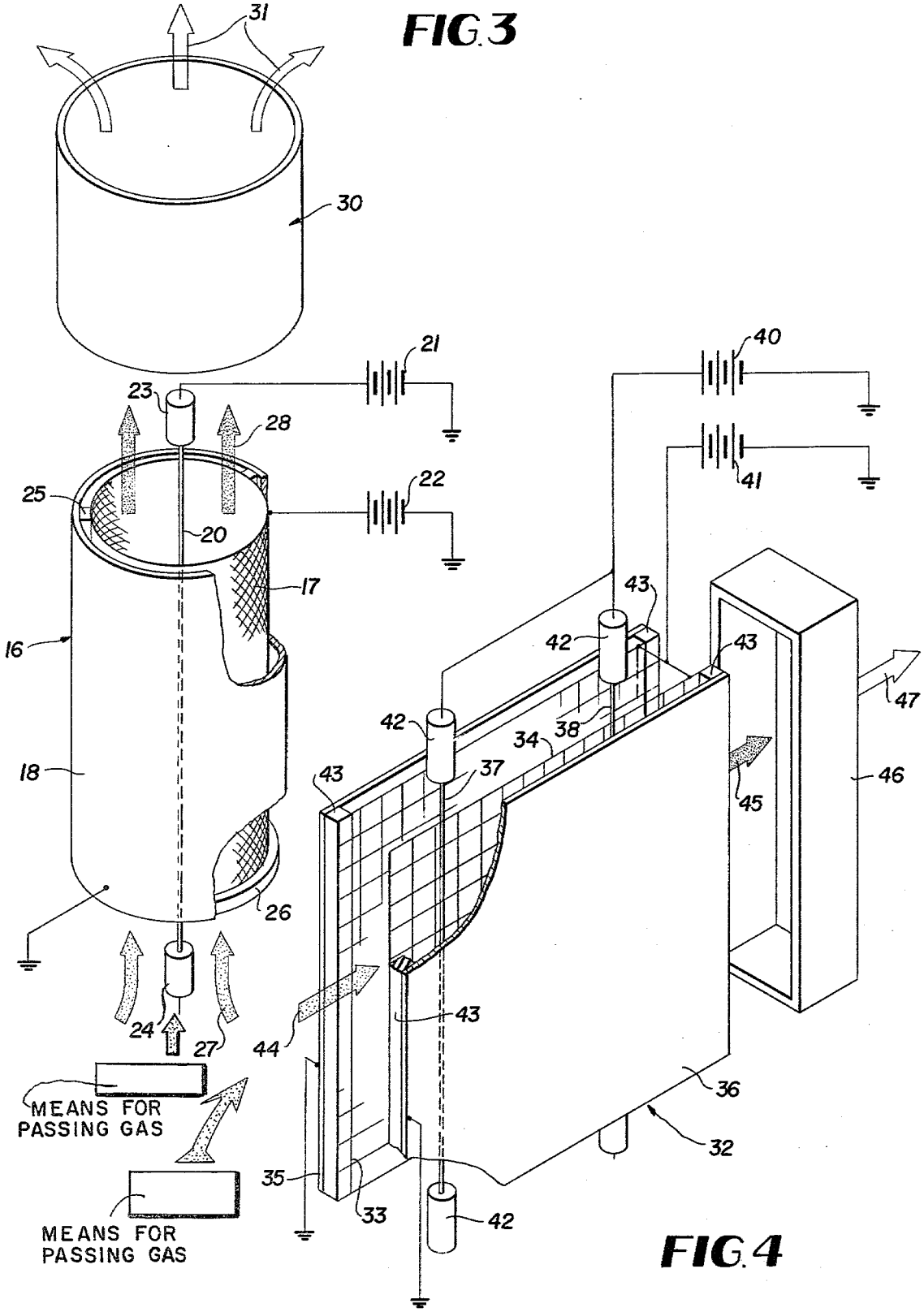
FIG. 3 is a partially schematic, pictorial view of an exemplary embodiment of a charging stage according to the present invention, shown in an electrostatic precipitator.
FIG. 4 is a partially schematic, pictorial view of a further exemplary embodiment of a charging stage according to the present invention, illustrated in an electrostatic precipitator.

Before turning to a detailed discussion of the two exemplary embodiments illustrated respectively in FIGS. 3 and 4, a brief discussion of the apparatus shown in FIG. 1 with reference to FIG. 2 is in order and serves to aid one in understanding the present invention.

The basic concept of the present invention and performance of a three electrode corona electrode arrangement is illustrated by reference to the simple corona geometry shown in FIG. 1. A corona discharge electrode 10 having a sharp point 11 is placed three centimeters from a flat plate passive electrode 12. An intermediate screen electrode 13, in the form of a wire screen with approximately 84% open area and 0.64 cm wire spacing is provided as the third electrode. The screen electrode 13 is placed at a distance of 1 cm from the passive electrode 12, two insulating members 9 being positioned between the screen electrode and the passive electrode. The current of each of the electrodes 10, 12, and 13 is monitored separately, respective microameters 14, 15 and 16 being provided for that purpose.

Since the screen electrode 13 serves as a trap for back corona ions, the onset of back corona should produce a simultaneous increase in current at the passive electrode 12 and at the screen electrode 13, with little effect on the current level at the discharge electrode 10. Experimental results demonstrating this behavior are presented in FIG. 2. An experiment was conducted in which the corona system of FIG. 1 was enclosed in an oven at 150° C., and redispersed flyash was injected into the air below the discharge electrode 10. After approximately four minutes operating time a very sharp rise in current at both the screen electrode 13 and the passive electrode 12 occurred, signaling the onset of back corona. The fluctuation in current at the discharge electrode 10 was very small in comparison. During this stage of the experiment, the voltage at the corona discharge electrode 10 was 15 kV and the voltage was 8 kV at the screen electrode 13. The passive electrode 12 was held at ground, that is zero potential. By adjusting the electrode voltages it was possible to arrive at steady-state conditions where the screen and passive electrode current levels were between three and ten times as great as the discharge electrode current.

The difference in the magnitude of current at the screen electrode 13 and passive electrode 12 is the amount of current from the discharge electrode 10 which has passed through the screen electrode 13 and arrived at the passive electrode 12. Current losses to the oven walls account for the experimental discrepancies.

The significance of the experimental results are best seen in the manner that the screen electrode current follows the fluctuations in the current at the passive electrode 12, while the discharge electrode current remains relatively constant for fixed values of applied voltage. Ions originating at the passive electrode as a result of back corona discharge, are effectively trapped successfully by the screen electrode 13.

In FIG. 2, the vertical dashed lines denote times at which the noted voltage changes at the screen electrode 13 and the discharge electrode 10 were made, these voltages being denominated respectively in FIG. 2 as $V_{Screen}$ and $V_{disch}$. Initially during the experiment, the screen electrode voltage was 8 kV and the discharge voltage was 13 kV.

Turning now to FIG. 3, a first specific, exemplary embodiment of an apparatus for reducing back corona discharge effects is shown incorporated into a charging stage operatively associated with an electrostatic precipitator or collecting stage.

As shown in FIG. 3, the exemplary embodiment of the charging stage is designated generally by the numeral 16.

A screen electrode 17 and passive electrode 18, shown partially broken away are respective coaxial electrodes of cylindrical construction in the form of a wire which is stretched along the axis of the system. The outer electrode 18 is grounded, and a high voltage, of either positive or negative polarity, is applied to the wire discharge electrode 20 from a D.C. power supply 21. A separate power supply 22 is used to maintain an electrical potential on the cylindrical screen electrode 17, with the same polarity, but lower magnitude than the voltage on the discharge electrode 20. With proper adjustment of the screen voltage, ions originating at the passive electrode 18 will be attracted to the screen electrode 17 so that the space between the corona sheath surrounding the the discharge electrode 20 and the screen electrode 17 will contain ions of principally one polarity. Particulate material passing through the region enclosed by the screen electrode may thus become charged without the contravening effects of back corona. The voltages applied to the discharge electrode 20 and the intermediate screen electrode 17 are high and can have the relative magnitudes mentioned above for electrodes 10 and 13 (FIG. 1) and be of the same or even greater absolute magnitudes. The discharge corona electrode 20 is supported by insulators 23 and 24, shown somewhat diagrammatically.

As shown in FIG. 3, respective insulating rings 25 and 26 are respectively positioned between the passive electrode 18 and the screen electrode 17 near the ends of these electrodes. The insulating rings 25 and 26 not only provide support for the screen electrode 17, but the lower ring 26 prevents dust, flyash and the like from initially entering the space between the passive electrode 18 and the screen electrode 17.

In operation, gas having particulate material such as dust, flyash or the like entrained therein, is fed under forced or natural draft into the charging stage 16 from one end thereof, shown near the lower portion of FIG. 3, as indicated by the arrow-headed lines 27. The gas with the entrained material is passed axially through the stage 16 and is consequently subjected to the electrical and ion fields between the discharge electrode 20, the screen electrode 17 and the passive electrode 18. As a result, the entrained particulate material becomes charged as a result of the corona discharge between the discharge electrode 20 and the passive electrode 18. Contemporaneously back corona discharge of ions from the passive electrode 18 to the discharge electrode 20 is effectively prevented; such back corona discharge of ions, which would otherwise make the ion field undesirably bipolar, being prevented by capture of such ions by the intermediate screen electrode 17.

The gas with the entrained particulate material, now charged, leaves the charging stage 16 from that end thereof shown near the upper portion of FIG. 3, as illustrated by the arrow-headed bold lines 28 and thence to a collecting stage, shown diagrammatically as numeral 30. The collecting stage 30 may take a number of conventional forms, such as those illustrated in the U.S. patent to Ta-Kuan Chiang, supra. The gas virtually free of the entrained particulate material leaves the collecting stage 30, as illustrated diagrammatically by the arrows 31.

As shown in FIG. 4, a further exemplary embodiment of an apparatus for reducing back corona discharge effects is shown incorporated into a charging stage which is operatively associated with an electrostatic precipitator or collecting stage.

The three-electrode concept can be applied to a parallel wire-plate geometry as illustrated in FIG. 4. As illustrated in FIG. 4, a charging stage 32 includes a pair of intermediate, flat, plane screen electrodes 33 and 34 and a pair of passive electrodes 35 and 36 positioned respectively in close vicinity of and spaced from the screen electrodes 33, 34. The screen electrodes 33, 34 and passive electrodes 35, 36 lie in parallel planes. A plurality of corona discharge electrodes 37 and 38, shown as two parallel wires, are positioned in the plane bisecting the space between the passive electrodes 35, 36. Operation of the system is similar to that described for the cylindrical configuration. The passive electrodes 35, 36 are grounded, and a high voltage is applied from a D.C. source 40 to the corona wire electrodes 37, 38. The screen electrodes 33, 34 are energized from a voltage source 41 with a voltage sufficient to trap any ions due to back corona discharge from the passive electrodes 35, 36. The substantially unipolar ion field between the screen electrodes 33, 34 serves as a charging region for particulate material passing through the charging stage. The magnitude and relative magnitudes of the voltages on the screen and discharge electrodes 33, 34, 37 and 38 are as in the embodiment of FIG. 3. The discharge electrodes 37, 38 are supported by conventional insulators 42 positioned near their respective ends. The screen electrodes 33, 34 are spaced from their respective associated passive electrodes 35, 36 by bar-shaped insulators 43 positioned between these electrodes in close vicinity to their top and bottom edges.

In operation, gas having particulate material, such as dust, flyash or the like entrained therein, is fed under forced or natural draft into the charging stage 32 from one end thereof, shown near the left-hand side of FIG. 4, as illustrated diagrammatically by the arrow 44. The gas with the entrained particulate material is passed through the stage 32 between the two screen electrodes 33,34 and is consequently subjected to the electrical and ion fields which exist as a result of the voltages applied to the electrodes. As a result, the entrained particulate material becomes charged because of the corona discharge between the discharge electrodes 37,38 and each of the passive electrodes 35,36. As in the embodiment of FIG. 3, back corona discharge from the passive electrodes 35,36 to the discharge electrodes 37,38 is effectively prevented. In this case, it is the action of the screen electrodes 33,34 which collect and capture such ions, thereby assuring that a substantially monopolar ion field exists between the screen electrodes 33,34.

The gas with the entrained particulate material, now charged, leaves the charging stage 32 from the right-hand side thereof, as diagrammatically illustrated by the arrow 45 and passes on to a conventional collection stage 46 having an opening in its end through which gas substantially free of particulate material passes out. It is to be understood that the charging stage 32 and the collection stage 46 can be placed within a housing or gas passageway and may in fact form portions of the housing so as to enclose the space between the ungrounded electrodes and through which the gas passes.

Alternate embodiments and variants of the invention include corona electrode systems of various geometrical configurations in which a screen or perforated metal electrode is placed between the corona discharge electrode and the passive electrode in such a manner as to provide for the removal of ions arising from back corona. The corona discharge electrode may be a straight wire or array of wires, barbed wire, helix or other form. The screen electrode will normally be placed nearer to the passive electrode than to the discharge electrode and conform approximately to the shape of the passive electrode. The function of the screen electrode in such devices is the same as that discussed above in connection with FIGS. 1, 3 and 4.

It is to be understood that the foregoing description and accompanying figures of drawing have been set out by way of example, not by way of limitation. Other embodiments and variants are possible without departing from the spirit and scope of the invention, its scope being defined in the appended claims.

What is claimed is:

1. A method of removing particulate material from gas using a charging stage and a separate electrostatic collecting stage while reducing back corona effects in the charging stage, the method comprising providing in said charging stage an ion field of given polarity between at least one corona discharge electrode and at least one passive electrode in said charging stage, removing ions of opposite polarity which may result from back corona discharge from said at least one passive electrode by capturing the ions of opposite polarity with at least one intermediate, apertured electrode positioned between said at least one corona discharge electrode and said at least one passive electrode, passing gas containing particulate material to be removed substantially longitudinally through the space between said at least one intermediate, apertured electrode and said at least one corona discharge electrode to charge said particulate material while preventing gas containing particulate material from longitudinally entering the space between said at least one passive electrode and said at least one intermediate electrode, and thereafter passing said gas containing said particulate material to be removed out from said charging stage containing said at least one corona discharge electrode, said at least one passive electrode and said at least one intermediate electrode, into said separate electrostatic collecting stage to collect said particulate material in said electrostatic collection stage.

2. A method according to claim 1 wherein the providing step includes supplying an electrical potential of given polarity to the at least one corona discharge electrode with respect to the at least one passive electrode, and supplying an electrical potential of the given polarity to the at least one intermediate electrode having a magnitude less than the magnitude of the potential supplied to the at least one corona discharge electrode.

3. A method according to either claim 1 or 2, including positioning the at least one intermediate electrode between the at least one corona discharge electrode and the at least one passive electrode relatively closer to the at least one passive electrode than the at least one corona discharge electrode.

4. An apparatus for removing particulate material from gas using a charging stage and a separate electrostatic collection stage while reducing back corona effects, the apparatus comprising said charging stage, said charging stage having at least one passive electrode, at least one corona electrode spaced from said at least one passive electrode and at least one apertured intermediate electrode positioned between said at least one corona electrode and said at least one passive electrode for intercepting ions originating from back corona discharge from said at least one passive electrode; means for applying a voltage of given polarity relative to said at least one passive electrode to said at least one corona electrode; means for applying a voltage of said given polarity relative to said at least one passive electrode to said at least one intermediate electrode at a lesser magnitude than the magnitude applied to said at least one corona discharge electrode; means for passing gas containing entrained particulate material longitudinally through the space between said at least one corona discharge electrode and said at least one intermediate electrode to charge the particles as a result of corona discharge from said at least one corona electrode; means for preventing longitudinal entry of gas containing entrained particulate material into the space between said at least one passive electrode and said at least one intermediate electrode; and wherein said separate electrostatic collection stage is positioned downstream from said charging stage.

5. An apparatus according to claim 4, wherein said at least one intermediate electrode comrises at least one screen electrode.

6. An apparatus according to claim 4, wherein said at least one passive electrode is cylindrical and has a longitudinal axis, said at least one corona discharge electrode is a wire electrode positioned along at least a protion of said axis, and said at least one intermediate electrode is cylindrical and is positioned coaxially with said at least one passive electrode.

7. An apparatus according to claim 4, wherein said at least one passive electrode comprises two passive electrodes spaced apart from one another and substantially parallel to one another, said at least one intermediate electrode comprises one intermediate, apertured electrode positioned between one of said passive electrodes and said at least one corona discharge electrode, and a further intermediate, apertured electrode positioned between the other of said passive electrodes and said at least one corona discharge electrode.

8. An apparatus according to claim 7, wherein said at least one corona discharge electrode comprises a plurality of corona discharge electrodes positioned between said two passive electrodes and substantially parallel to said two passive electrodes.

* * * * *